US009078525B2

(12) United States Patent
O'Sullivan

(10) Patent No.: US 9,078,525 B2
(45) Date of Patent: Jul. 14, 2015

(54) LATERAL SUPPORT APPARATUS FOR A CHAIR

(76) Inventor: Andrew Laurence O'Sullivan, Auckland (NZ)

( * ) Notice: Subject to any disclaimer, the term of this patent is extended or adjusted under 35 U.S.C. 154(b) by 0 days.

(21) Appl. No.: 14/118,402

(22) PCT Filed: May 21, 2012

(86) PCT No.: PCT/NZ2012/000067
§ 371 (c)(1),
(2), (4) Date: Nov. 18, 2013

(87) PCT Pub. No.: WO2012/161590
PCT Pub. Date: Nov. 29, 2012

(65) Prior Publication Data

US 2014/0217803 A1 Aug. 7, 2014

(30) Foreign Application Priority Data

May 20, 2011 (NZ) ..... 592974

(51) Int. Cl.

| | |
|---|---|
| ***A47C 7/36*** | (2006.01) |
| ***A47C 7/62*** | (2006.01) |
| ***A47C 7/38*** | (2006.01) |
| ***A61G 5/12*** | (2006.01) |
| ***A61G 15/02*** | (2006.01) |
| ***A61G 15/12*** | (2006.01) |
| *A61G 7/057* | (2006.01) |
| *A61G 5/10* | (2006.01) |

(52) U.S. Cl.
CPC ... *A47C 7/62* (2013.01); *A47C 7/38* (2013.01); *A47C 7/383* (2013.01); *A61G 5/12* (2013.01); *A61G 15/02* (2013.01); *A61G 15/12* (2013.01); *A61G 7/057* (2013.01); *A61G 2005/1048* (2013.01)

(58) Field of Classification Search
CPC ..... A47C 7/62; A47C 7/38; A47C 7/383; A61G 5/12; A61G 15/02; A61G 15/12; A61G 7/057; A61G 2005/1048
USPC ..... 297/406, 407, 398, 411.23, 284.9, 488, 297/487; 248/259
See application file for complete search history.

(56) References Cited

U.S. PATENT DOCUMENTS

| | | | | | |
|---|---|---|---|---|---|
| 1,699,179 | A | * | 1/1929 | Bouma | 248/259 |
| 2,755,101 | A | * | 7/1956 | Budde | 280/748 |
| 3,206,249 | A | * | 9/1965 | Gateley | 297/411.23 |
| 3,635,526 | A | * | 1/1972 | Posey | 297/488 |
| 3,730,589 | A | * | 5/1973 | Lane | 297/391 |
| 4,073,537 | A | * | 2/1978 | Hammersburg | 297/464 |
| 4,617,919 | A | * | 10/1986 | Suhre | 280/250.1 |

(Continued)

FOREIGN PATENT DOCUMENTS

| | | |
|---|---|---|
| CN | 201227368 | 4/2009 |
| DE | 10018453 | 10/2001 |

*Primary Examiner* — Milton Nelson, Jr.
(74) *Attorney, Agent, or Firm* — Dann, Dorfman, Herrell and Skillman, P.C.

(57) ABSTRACT

An apparatus for removably attaching a lateral support to a chair. The apparatus comprises a support frame removably attachable to the chair. The support frame comprises two side members and a lateral member coupled between the side members spacing the side members apart by a lateral distance, and an adjustment mechanism that is operable to adjust the lateral distance between the two side members to clamp the chair between the side members. The apparatus comprises a lateral support attachable to a said side member.

10 Claims, 11 Drawing Sheets

(56) References Cited

U.S. PATENT DOCUMENTS 5,613,738 A * 3/1997 Britton ..... 297/467
5,673,888 A 10/1997 Garguilo
5,967,613 A 10/1999 McKeever
6,460,927 B1 * 10/2002 Groth ..... 297/284.9
6,508,513 B1 * 1/2003 Hall et al. ..... 297/411.25
2009/0125055 A1 5/2009 Larkin et al.

* cited by examiner

LATERAL SUPPORT APPARATUS FOR A CHAIR

FIELD OF THE INVENTION

The present invention relates to a lateral support apparatus for a chair.

BACKGROUND TO THE INVENTION

Many long term care facilities and private persons within their home environment utilize a common arm chair or easy or reclining chair for sitting supported for long periods of time.

Many of these persons are advanced in age and have lost tone, musculature, and the ability to hold their spines in a straight position in the chair.

An example of this is a person suffering Cardio Vascula Accident (CVA) commonly referred to as a stroke. The hemiplegic paralysis cause musculature to waste on the side of the body affected.

As the muscle wastes the person leans to one side more and more over time until they collapse. This position causes many side effects including but not limited to collapse of vascular beds, scoliosis, pressure ulcers, shearing ulcers, pain and discomfort. As well as these physical effects that affect a person's health, uncontrolled leaning or collapsing to one side can affect a person's ability to function and participate with their community.

There are many other conditions that can cause leaning to one side. Indeed, many/most people will have some form of scoliosis by the time they are old. This will lead to similar issues as those expressed for persons with CVA.

Seating support issues are addressed by specialized wheel chairs with full seating systems or backrests with lateral supports and specialized pressure care products.

Also, specialized arm chairs or easy or reclining chairs with lateral supports are available. Specialized chairs providing lateral support have lateral supports integrally built into the chair, or specialty chairs are provided with mounting systems to which optional proprietary supports can be fitted. Such specialized chairs are expensive.

Another known lateral support system uses foam supports that sit loosely or are fixed to a chair using hook-and-loop attachment straps. Such supports can be difficult to use. The position of these supports can shift or move on the chair. The position of the supports may be difficult to replicate between uses, and these supports can collapse or condense through use over time.

It is an object of the present invention to provide an improved lateral support system and/or apparatus for a chair, or to at least provide the public or medical care professionals a useful choice.

SUMMARY OF THE INVENTION

In a first aspect, the present invention consists in an apparatus for removably attaching a lateral support to a chair comprising:

a support frame removably attachable to the chair, the support frame comprising two side members and a lateral member coupled between the side members spacing the side members apart by a lateral distance, and an adjustment mechanism that is operable to adjust the lateral distance between the two side members to clamp the chair between the side members, and a lateral support attachable to a said side member.

Preferably the length of the lateral member is adjustable using the adjustment mechanism to clamp the chair between the side members.

In one embodiment, the support frame comprises two lateral members arranged side-by-side and extending between the side members.

In one form, the support frame comprises a joint between each side member and the lateral member, the joint providing at least one degree of freedom of movement between each side member and the lateral member. Preferably the joint is a pin joint.

Preferably the pin joint has a vertically arranged pin, the pin joint allowing rotation of the side member relative to the lateral member about a vertical axis in use. In one form, the vertical axis is substantially perpendicular to the longitudinal axis of the lateral member.

Preferably the joint allows the side members to pivot relative to the lateral member allowing a forward end of the side members to move together or apart.

Preferably the relative position between the side member and the lateral member can be locked after adjustment to a desired position at least when the support frame has been attached to a chair.

In one embodiment, the support frame has two said lateral members, a forward lateral member and a rearward lateral member, the forward lateral member and the rearward lateral member coupled between the side members spacing the side members apart. Preferably the relative position between the side members and the lateral members is locked when the support frame has been attached to a chair by setting the relative lengths of the forward and rearward lateral members to clamp the frame to a chair.

In one embodiment, the lateral member is an adjustable length strut comprising a first strut part and a second strut part, the first part received in the second part, and the adjustment mechanism comprises a locking element fitted to the first strut part and a series of holes spaced along the length of the second strut part, each hole for receiving the locking element to set the length of the strut.

In one embodiment the apparatus further comprises a first adjustment mechanism and a second adjustment mechanism, the first adjustment mechanism providing a coarse adjustment of the length of the lateral member and the second adjustment mechanism providing a fine adjustment of the length of the lateral member. Preferably the lateral member comprises a strut, a first end part and a second end part, the first end part attached at one end of the strut by a left hand thread and the second end part attached at the other end of the strut by a right hand thread, the left hand thread and the right hand thread providing the second adjustment mechanism, fine length adjustment achieved by rotation of the strut with the first and second end parts fixed to the side members.

Preferably the apparatus comprises an attachment arm attached to a said side member, the attachment arm and the corresponding side member adapted for positional adjustment there between, the lateral support being attached to the side member by the attachment arm.

Preferably the attachment arm is moveable relative to the corresponding side member in a direction transverse to the lateral member.

Preferably the attachment arm is pivotable relative to the corresponding side member in a plane that is parallel to a plane of the corresponding side member.

Preferably the attachment arm is attached to the side member with a fastener passed through at least one slot in one of the attachment arm and the side support, the at least one slot allowing relative movement between the attachment arm and the side member, the relative position of the attachment arm and the side member being set by tightening the fastener to rigidly clamp the attachment arm to the side member.

Preferably the slot is aligned in a forward and backward direction allowing forward and backward positioning of the attachment arm relative to the support frame. In one form, the slot allows the attachment arms to be positioned further towards or away from the lateral member.

Preferably the attachment arm is attached to the side member with fasteners, one fastener passed through an arc shaped slot in one of the attachment arm and the side member, the arc shaped slot allowing the attachment arm to rotation relative to the side member.

Preferably the lateral support is a resilient pad with a rigid back for attachment to the support frame, and the apparatus comprises a connecting element connecting the lateral support to a said side member.

Preferably the lateral support is a resilient pad with a rigid back for attachment to the support frame, and the apparatus comprises a connecting element connecting the lateral support to the side member via the attachment arm.

Preferably the lateral member has a square hollow cross section.

Preferably the lateral member is rigidly fixed to each side member.

Preferably the lateral member is an adjustable length strut comprising a first strut part and a second strut part, the first part received in the second part, and the adjustment mechanism sets the position of the strut first part relative to the strut second part to set the length of the strut.

Preferably the adjustment mechanism comprises a clamp.

Preferably the clamp is a trigger clamp fixed to the second part and adapted to releasably grip or clamp the first part to set the lateral distance between the side members.

Preferably the clamp is a trigger clamp adapted so that the length of the lateral member is shortened by depressing a trigger of the trigger clamp.

Preferably an interface pad is provided to an inside surface of each side member for interfacing to or contacting a chair to which the apparatus is to be attached.

Preferably a said side member comprises a laterally extending flange.

Preferably the apparatus comprises connecting element for supporting the lateral support from a said side member, the connecting element comprising a length adjustable assembly for adjusting the length of the connecting element for positioning the lateral support laterally.

Preferably the connecting element comprises a connecting element first part and a connecting element second part, the connecting element first part received in the connecting element second part for length adjustment of the connecting element, and a clamp for fixing the connecting element first and second parts together to set the length of the connecting element.

Preferably the clamp is a wedge clamp comprising a wedge and a threaded member, the wedge having a threaded bore for receiving the threaded member, the threaded member received in the connecting element first part, the wedge having a sloping side that contacts a complementary sloping end of the connecting element first part, the wedge received in the connecting element second part.

In a second aspect, the present invention consists in a support frame adapted to be removably attached to a chair for attaching lateral supports to the chair, the support frame comprising:

two side members, a lateral member coupled between the side members spacing the side members apart by a lateral distance, and an adjustment mechanism to adjust the lateral distance between the two side members to in use releasably clamp the chair between the side members.

The second aspect of the invention may comprise any one or more of the features described above in relation to the first aspect of the invention.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

The invention consists in the foregoing and also envisages constructions of which the following gives examples only.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

The invention relates to a support frame and lateral support apparatus that can be removably attached to a common arm chair or easy or reclining chair for use by a person requiring additional lateral support beyond what a common chair can provide.

A first embodiment of the lateral support apparatus will be described with reference to FIGS. 1 to 9. Referring to FIGS. 1 to 4, in one form the invention comprises a removable support frame for clamping to the chair, and at least one lateral support being attachable to the support frame. The removable support frame 1 comprises a first side member 2 and a second side member 3 coupled together via at least one lateral member 4, 5. The lateral member is elongate and the side members extend from the respective ends of the lateral member in a direction that is transverse to the longitudinal axis of the lateral member. Each side member has a front end and a rear end. A respective end of the lateral member is coupled at or toward the rear end of each side member. Preferably each side member is a plate, and the at least one lateral member is an elongate strut. The side members are coupled together by the lateral member to be spaced apart by a lateral dimension determined by the length of the strut. The support frame 1 provides for adjustment of the lateral dimension between the side members so that the distance between the side members is adjustable.

Preferably adjustment of the distance between the side members is achieved by providing a lateral member having an adjustable length. By adjusting the length of the lateral member, a user or care-provider can set a required lateral dimension between the side members to rigidly attach the frame to a chair by clamping the chair between the side members. In this embodiment the lateral member is provided with more than one length adjustment means. For example, the lateral member preferably has a coarse length adjustment means and a fine length adjustment means.

The terms 'coarse adjustment' and 'fine adjustment' are not intended to define absolute amounts of adjustment, but are intended to define relative amounts of adjustment. Fine adjustment provides for smaller changes in length relative to the changes in length provided by the coarse adjustment. Alternatively fine adjustment provides for any change in length to be made up to a maximum predetermined amount, and coarse adjustment provides for a predetermined number of discrete step changes in length to be made.

Figure 1:
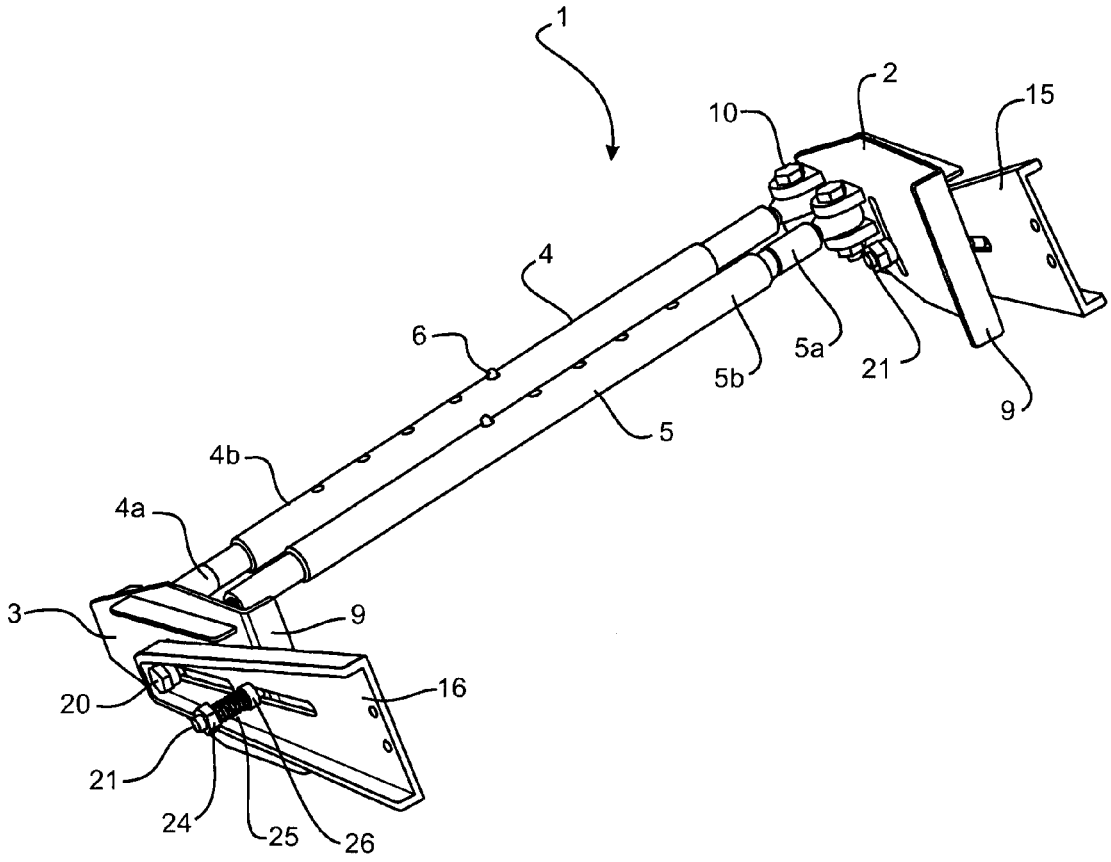
FIG. 1 is a perspective view of a support frame for removably attaching lateral supports to a chair in accordance with a first embodiment of the invention.
Figure 2:
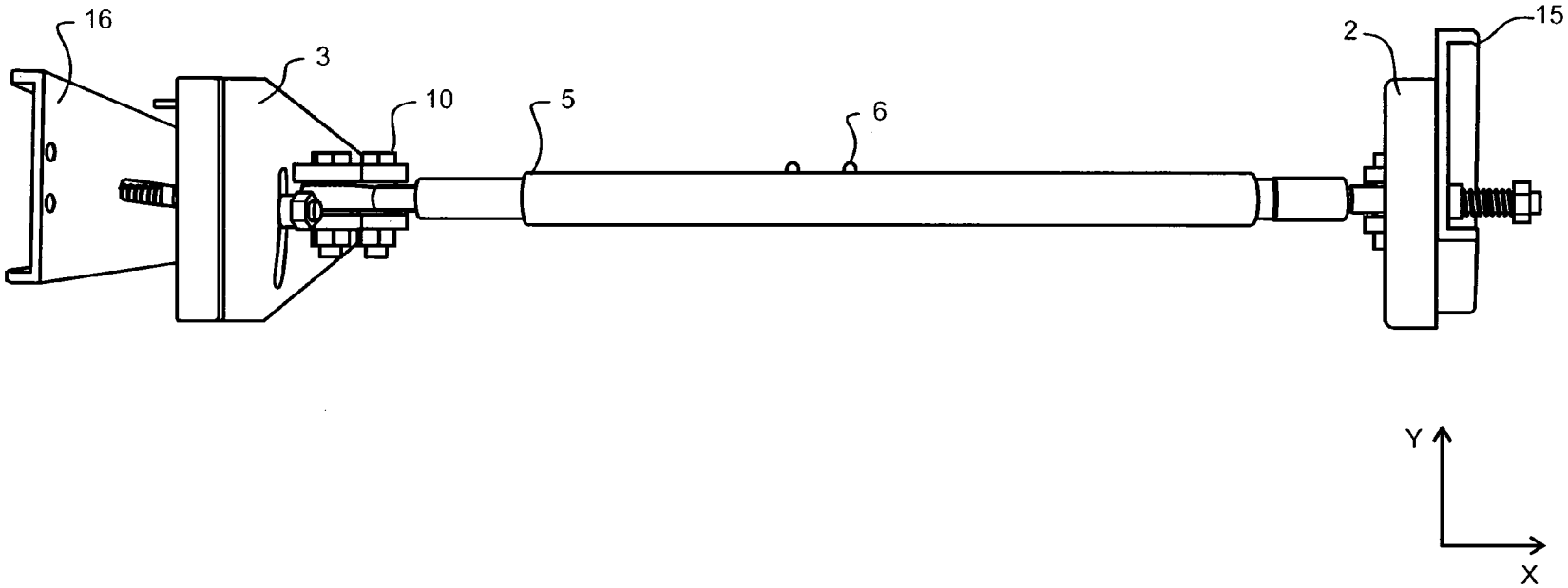
FIG. 2 is a front view of the support frame shown in FIG. 1.
Figure 3:
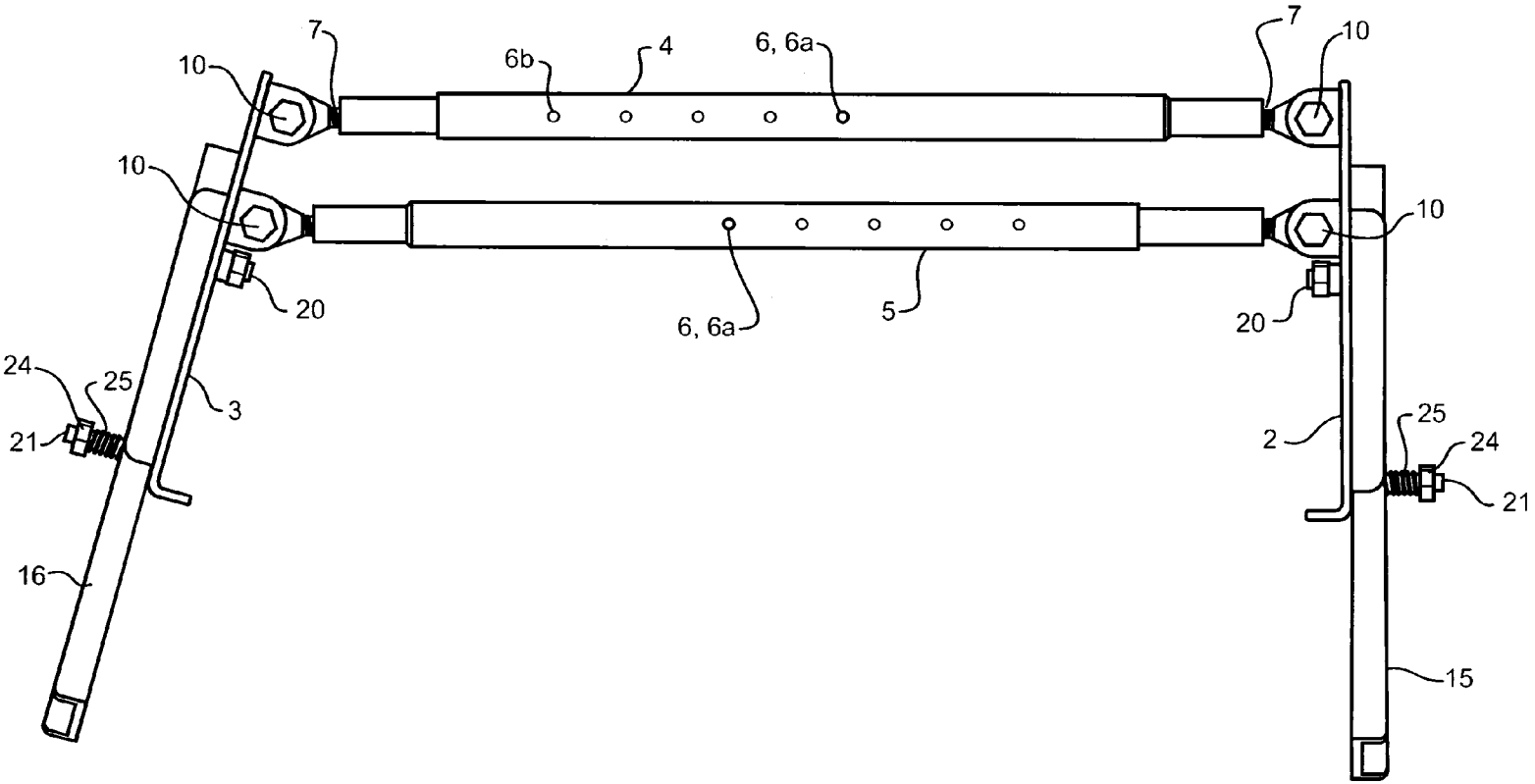
FIG. 3 is a top view of the support frame shown in FIG. 1.
Figure 5:
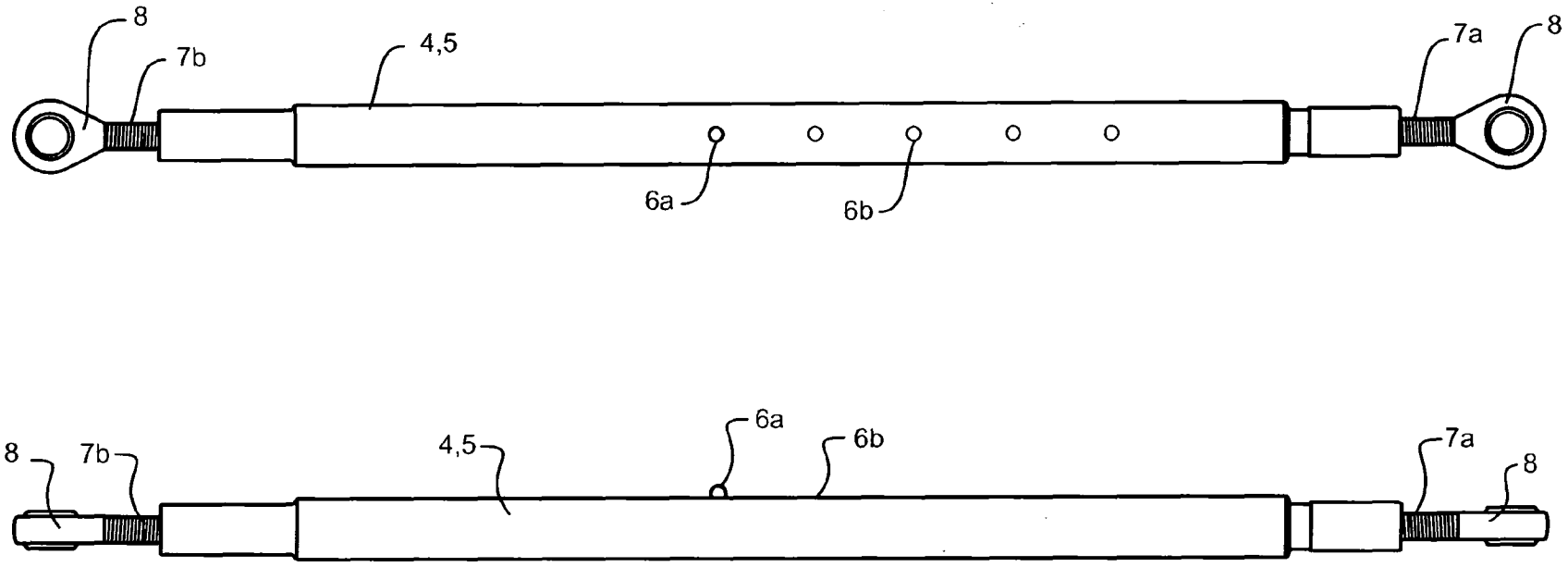
FIG. 5 illustrates lateral members of the support frame of FIG. 1.
Figure 6:
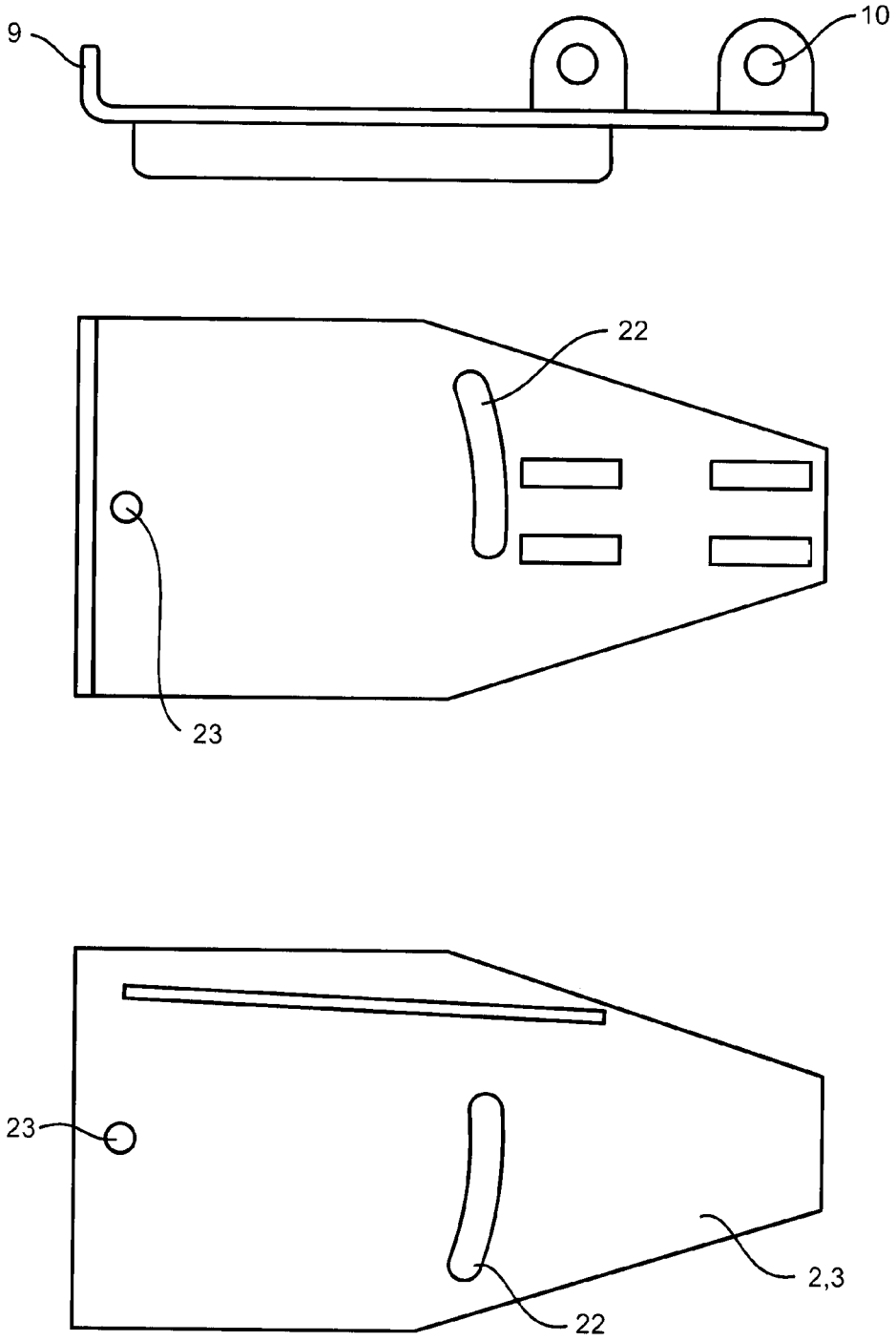
FIG. 6 provides a number of views on a side member of the support frame of FIG. 1.
Figure 7:
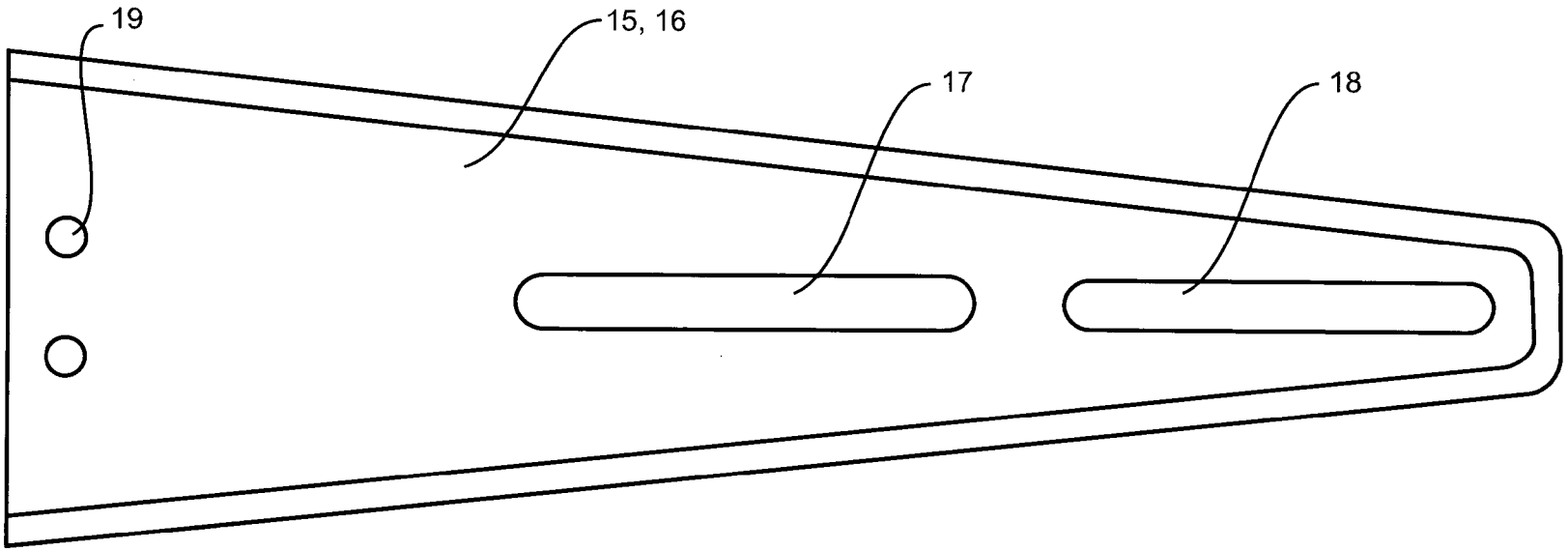
FIG. 7 is a side view of an attachment arm included as part of the support frame of FIG. 1.

By example, the lateral member of this embodiment is an adjustable length strut having a coarse length adjustment means and a fine length adjustment means. The strut is a telescopic strut comprising a first part 5*a* longitudinally received inside a second part 5*b*. For example, the strut length is adjusted by telescoping the first part and second part to lengthen or shorten the strut. The length of the strut is adjustable by moving or sliding the relative positions of the strut first and second parts to achieve a coarse length adjustment. To set the relative positions of the strut first and second parts, a locking mechanism 6 is provided between the first and second strut parts. For example, the locking mechanism is a pin 6*a* or ball bearing fitted to the first strut part and received in one of a series of holes 6*b* in the second strut part as shown in FIGS. 3 and 5. The distance between adjacent holes 6*b* defines a minimum adjustment amount or discrete step for coarse length adjustment.

Referring to FIG. 5, fine length adjustment in the preferred lateral member is achieved by a screw thread 7. Preferably a strut end part 8 is attached to the strut 5 by the thread 7 providing fine length adjustment by threading the strut end 8 onto or from the end of the strut. Preferably each end of the strut is fitted with a strut end part 8 attached to the strut assembly by a screw thread 7, e.g. first strut end 8*a* attached to first part 5*a*, and second strut end 8*b* attached to second part 5*b*. Preferably the screw thread at one end of the strut is a left hand thread 7*a* and the screw thread at the other end of the strut is a right hand thread 7*b*, so that fine length adjustment can be achieved by rotation of the strut 5 relative to the end parts 8 with the end parts 8 of the lateral member fixed to the side members 2 and 3. For example, 180 degree turn of the strut adjusts the length of the strut by one pitch of the threads 7*a*, 7*b* where the thread at each end is the same. Preferably the strut has flats (not shown) for engagement by a tool, for example a spanner, for turning the strut for fine adjustment of the length.

In another form of this embodiment, the support frame comprises a single adjustable length lateral member fitted between two side members. The support frame is fitted to a chair by clamping the support frame to the seat back. When fitted, the lateral member extends laterally across the seat back behind the chair. The first and second side members contact sides of the seat back, and the seat back is clamped between the side members by adjusting the length of the lateral member to secure the support frame to the seat back. A clamping force between the sides of the seat back and the side members of the support frame is achieved by setting the length of the strut appropriately through initial coarse length adjustment and secondly fine length adjustment of the strut length. A user or care-giver shortens the length of the lateral member to clamp the chair between the side members.

In this embodiment, the support frame provides at least one degree of freedom between the side members 2, 3 and the lateral member 5. Where the lateral direction is defined as being along an X axis, the vertical direction along a Y axis, and the forward and back direction along a Z axis, preferably the lateral member is coupled to the side members so that the side members can rotate or pivot relative to the lateral member about a Y axis (for example an axis that extends substantially perpendicularly to the longitudinal axis of the lateral member) as best indicated in FIG. 3. This freedom of movement allows the support frame to be fitted to a chair where the angle of the sides of the seat back relative to the lateral member of the support frame when viewed from above is not known. The angle between each side member and the lateral member can be adjusted to match a particular chair. Connection between the lateral member and the side members preferably allows for the angle between the side members and the lateral member to be adjustable in the horizontal or XZ plane. Furthermore, the adjustment in the XZ plane allows support pads or elements (described below) fixed or mounted to the support frame to be moved towards or away from the centre of the chair, providing adjustment of the lateral position of the support pads to suit a particular person's positional needs when seated in the chair.

In this first embodiment, the connection between the side members 2, 3 and the lateral member 5 is made by a vertical pin joint 10 allowing each side member to pivot relative to the lateral member 4 about a vertical axis, the Y axis defined above.

For an embodiment with a single lateral member coupled between the side members, where the angle between the side members and the lateral member is adjustable, it is necessary to set or rigidly fix the angle of each side member relative to the lateral member after adjustment. In one embodiment, the angle between the lateral member and the side member can be fixed by using a bolt and nut, the bolt acting as the pin in the pin joint between the side members and the lateral member. Once the angle is set the nut is tightened to clamp the end of the lateral member rigidly to the side member to fix the angle between the side member and the lateral member.

In this first embodiment, the angle between the side members 2, 3 and the lateral member 5 is set by incorporating two lateral members 4 and 5 or struts in the support frame 1. Each end of each lateral member 4, 5 is coupled to a side member via a pin joint 10. By providing two lateral members, the pint joints between each lateral member and a side member do not need to be rigidly fixed. The angle between the side members and the two lateral members is fixed by adjusting and fixing the lengths of the two lateral members when fitting the frame to a chair. In this preferred embodiment, it is not necessary to fix the angle between the side members and the lateral members by locking the position of the joints between the lateral members and the side members. When the frame is clamped to the chair, the two lateral members provide the clamping force to hold the frame on the chair and also rigidly fix the angle of the side members 2, 3 to the lateral members 4, 5. This first embodiment comprising two lateral members allows for easy adjustment and attachment of the support frame to the back rest of a chair.

By lengthening the rear most lateral member 4 and shortening the forward most lateral member 5, the front of the side members 2, 3 are moved together to position lateral supports 30 (described below) fixed to the side members closer to the centre of the chair. By shortening the rear most lateral member 4 and lengthening the forward most lateral member 5, the front of the side members 2, 3 are moved apart to position lateral supports 30 (described below) fixed to the side members further from the centre of the chair. The two individually adjustable length lateral members provide for lateral position adjustment of side support pads to suit a particular person's positional needs when seated in the chair, or to match the angle between each side member and the lateral member to suit a particular chair.

Figure 8A:
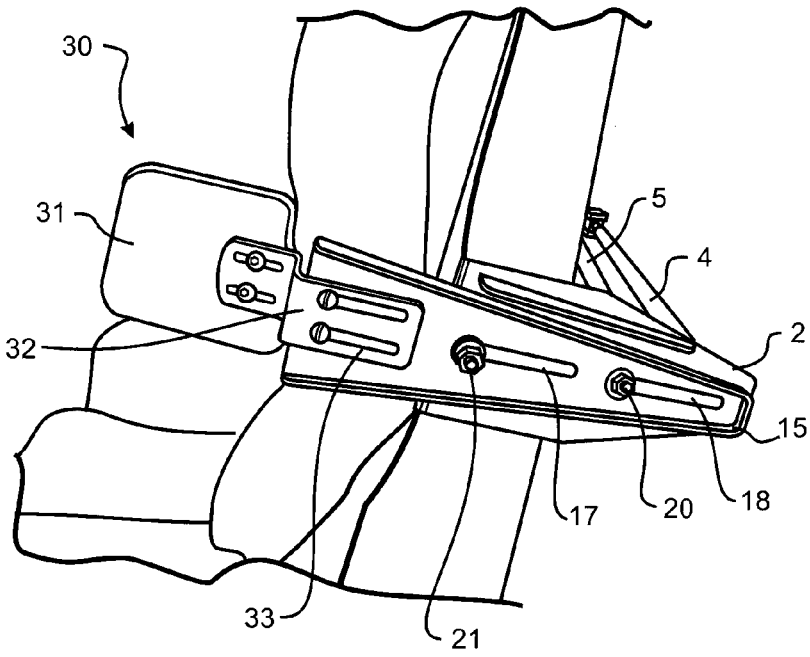
FIGS. 8*a* and 8*b* are views from a side of the support frame of FIG. 1 attached to an easy chair and supporting a lateral support.
Figure 8B:
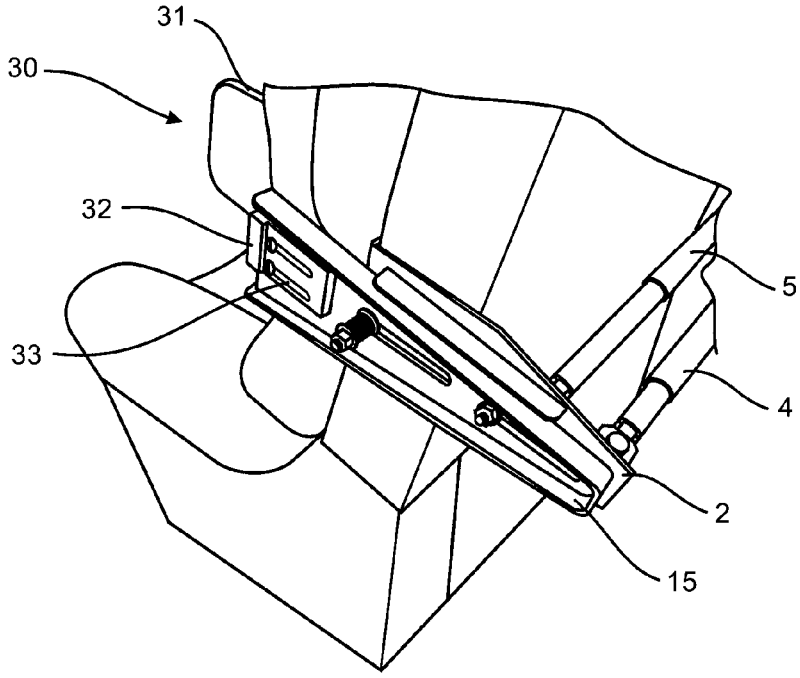

FIGS. 8*a* and 8*b* show one end of the first embodiment support frame with the support frame attached to the back rest of a common every day arm chair. The support frame is fitted to the chair by initially adjusting the length of each lateral member using the coarse length adjustment means so that the angle of each side member approximately corresponds to the angle of the sides of the chair back rest. With the support frame in place, the length of each lateral member is adjusted using the fine adjustment means to set the angle of the side members to match the chair and to shorten the lateral members to rigidly clamp the chair back rest between the support frame side members 2, 3.

To assist with positioning the frame onto the chair the side members have a laterally extending flange 9. This flange can be hooked onto a front edge of a back rest frame of the arm chair to which the support frame 1 is being fitted.

Once fitted to any chair, the support frame provides a means for attaching lateral supports to that chair. For example, the support frame provides a means by which to fix lateral supports to any chair without the necessity to purchase expensive specialised chairs with either built in lateral supports or means for attaching proprietary lateral supports.

A lateral support comprises a pad or support element that contacts a person sitting in the chair to help keep that person upright, where that person would otherwise collapse having lost the ability to hold their spine in a straight position through, for example, having suffered a stroke.

Figure 9:
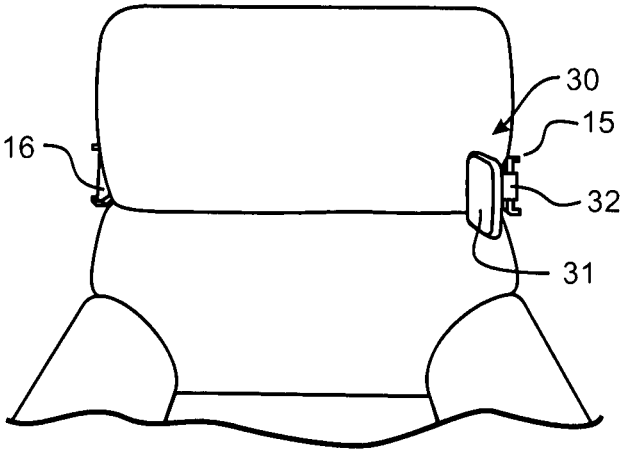
FIG. 9 is a front view of an easy chair with the support frame of FIG. 1 attached and supporting a lateral support.

FIG. 9 illustrates a common arm chair with the support frame according to the first embodiment fitted (mostly obscured from view). Such a chair may also be described as an easy chair and may have a reclining function to adjust the position of the back rest from an upright position to a reclined position. A lateral support 30 is attached at one side of the support frame 1. In use, typically a lateral support is attached at both sides of the support frame, one lateral support attached to a respective side member 2, 3 of the support frame, to contact a person's left and right side while sitting in the chair. The lateral support is attached directly or indirectly at or toward the front end of the side member.

In one form, the lateral support 30 is attached directly to a side member 2, 3 of the support frame. For example, a lateral support may be fitted to a side member 2, 3 using machine screws or any other suitable mounting or fixing system.

In another form illustrated in FIGS. 1 to 9, the support frame further comprises attachment arms 15, 16. A lateral support 30 for contacting a person seated in a chair is fixed to the support frame via a said attachment arm 15, 16.

The position of the attachment arm may be adjusted relative to the frame side member so that once the support frame is attached to a chair the position of the lateral supports 30 can be adjusted to suit a particular person using the chair. The position of the attachment arm may be adjusted relative to the frame side member to position attachment details on the attachment arm at a desired position with respect to the chair to which the support frame is attached. A lateral support can then be attached to the attachment detail of the attachment arm. For example the attachment arm may include threaded holes 19 for attaching a lateral support.

Figure 4:
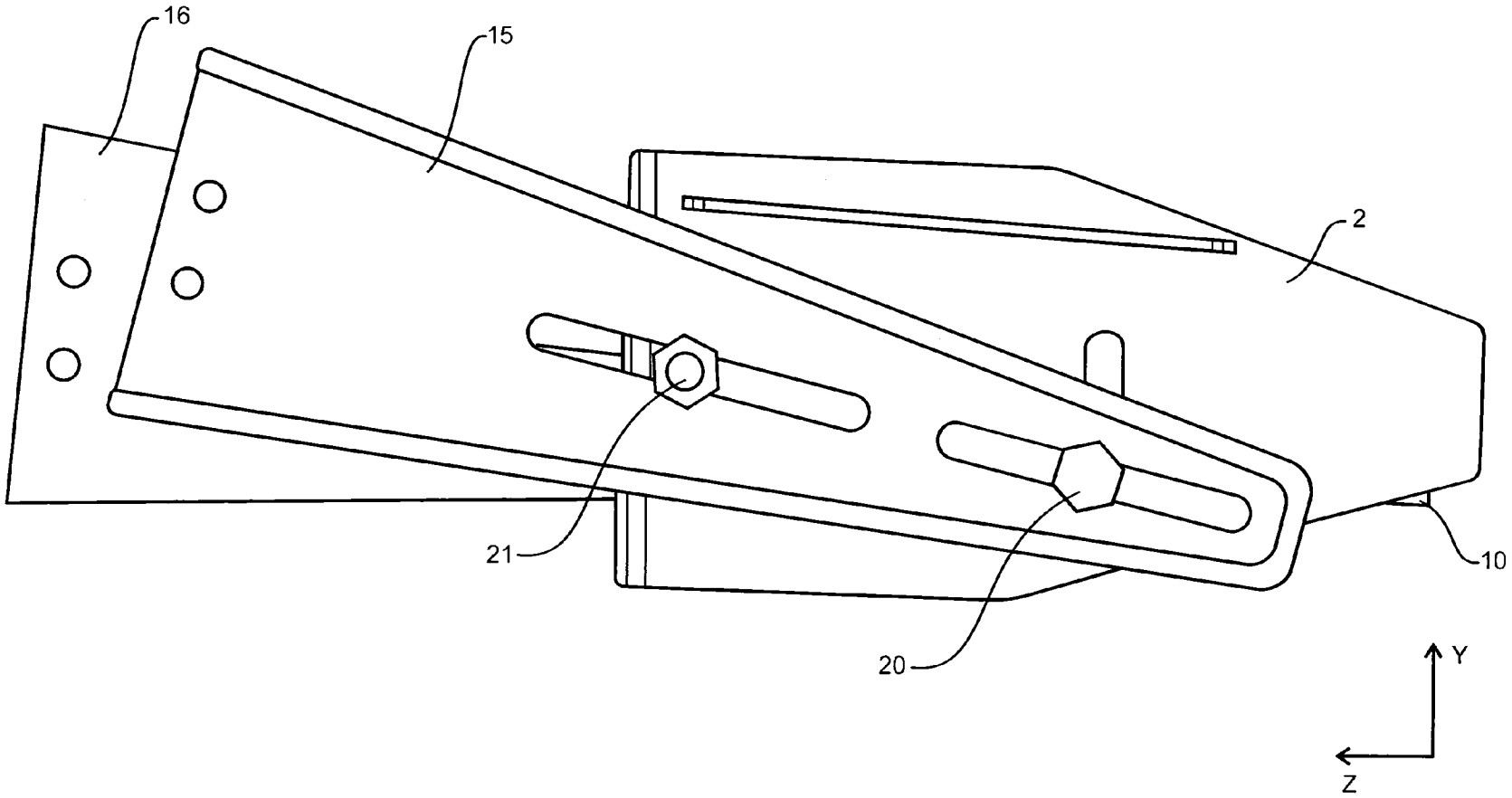
FIG. 4 is a side view support frame shown in FIG. 1.

Preferably the support frame 1 and arms 15, 16 are arranged so that the arms are moveable forward and backward relative to the support frame and chair (movement in the Z direction defined above, the Z direction is indicated in FIG. 4). To achieve forward and backward movement between the arms and the support frame the arms may be slidably mounted to the frame. For example, the arms have a slot or slots 17, 18 for receiving a fastener or fasteners 20, 21 for fixing the arms 15, 16 to the side members 2, 3 of the support frame 1. Preferably each arm is fitted to a respective side member with a fastener, for example a bolt or machine screw, passing through the slot in the arm. For example, each side member could have a threaded hole corresponding with the slot in the attachment arm for receiving a machine screw. Alternatively each side member could have a through hole corresponding with the slot in the attachment arm for receiving a bolt for use with a nut.

Preferably each arm 15, 16 is fixed to a respective side member 2, 3 using two fasteners. In the illustrated embodiment each attachment arm has two slots and a fastener 20, 21 passing through each slot. Alternatively the attachment arms could have a single slot with two fasteners passing through the single slot for fixing the arms to their respective side members of the support frame. In the illustrated embodiment the fasteners are bolts passing through holes in the side members and the slots in the arms, and each arm is fixed to the respective side member by tightening a nut on each bolt once the desired forward and backward position of the attachment arms has been determined. The nut and bolt arrangement clamps the attachment arms 15, 16 to the respective side members 2, 3 of the support frame 1.

In addition to forward and backward movement between the attachment arms and the side members of the support frame, preferably the arms and the support frame are arranged to allow the arms 15, 16 to pivot in the YZ plane relative to the support frame. For example, in one embodiment, the arms and support frame are arranged so that each arm pivots in a plane that is parallel to a plane of the respective side member to which it is attached. In this first embodiment, pivoting movement between a said arm and the corresponding side member is provided by an arc shaped slot 22 spaced from a fastening hole 23 in the side member. The arms pivot about an axis substantially perpendicular to the plane of the side members 2, 3. The arc shaped slot is spaced rearward of the fastening hole. Alternatively the arc shaped slot may be positioned to the front of the side member and the fastening hole 23 towards the rear of the side member. The fastening hole and the arc shaped slot receive the bolts for fastening the arm to the side member through the slots in the attachment arm 15, 16. The arc shaped slot 22 allows the attachment arm to pivot relative to the side member about the fastening hole 23.

With the support frame 1 securely attached to the seat back the position of the arms 15, 16 are adjusted to a desired position with fasteners 20, 21 loosened. Adjustment is made through the slots 17, 18 on the arms 15, 16 and the arc shaped slot 22 on the side members of the frame 1. To fit the arms in the desired position relative to the support frame the fasteners 20, 21 are tightened to clamp the arms to the side members rigidly. Friction between the arms and the side members is sufficient to hold the arms rigidly to the side members under sufficient clamping force. To assist with setting the clamping force one or both fasteners 20, 21 may be fitted with a resilient member 25, for example a spring, between the nut 24 and the arm 15, 16 or between the nut 24 and a washer 26. Alternatively or additionally some indexing arrangement may be used between the arms and the side members to secure the relative position of these parts.

With the support frame securely attached to the chair and the positions of the arms 15, 16 set appropriately, lateral supports can be fitted to the arms to provide lateral support to a person using the chair. The lateral support 30 is generally an assembly comprising a resilient pad 31, for example a foam pad, supported by a rigid backing member. A connecting element 32 connects between the resilient pad and the support frame 1.

In the first embodiment, adjustment slots 33 and fasteners are provided between the arm 15, 16 and the lateral support connecting element 32 to provide positional adjustment of the lateral supports in the forward and rearward direction. Furthermore, the lateral support connecting element 32 may comprise a forward part and a rearward part and lateral positional adjustment between the forward and rearward parts (not shown).

A second embodiment of the lateral support apparatus will now be described with reference to FIGS. 10 and 11. A lateral support frame 101 comprises a first side member 102 and a second side member 103 coupled together by a lateral member 105. The lateral member is elongate and the side members extend from the respective ends of the lateral member in a direction that is transverse to the longitudinal axis of the lateral member. Each side member is a plate, for example as described with reference to FIG. 1. The lateral member is an adjustable length strut comprising a first part 105*a* longitudinally received inside a second part 105*b*. The strut length is adjusted by telescoping the first part and second part to lengthen or shorten the strut. As illustrated, preferably the strut parts 105*a* and 105*b* have a square hollow cross section. Alternatively the cross section may be rectangular or circular or other shape.

To set the relative positions of the strut first and second parts, a locking mechanism or clamp 106 is provided between the first and second strut parts. The preferred form of the clamp is a trigger style clamp, similar to a style of clamp used in carpentry. The clamp is rigidly fixed to the second part 105*b* and is adapted to releasably grip or clamp the first part 105*a* to set the lateral distance between the side members 102, 103. The clamp may comprise a ratchet mechanism, for example, each depression of the trigger shortening the strut by an indexed distance. In this embodiment, the clamp is adapted so that the length of the lateral member is shortened by depressing the trigger 106*a*. Repeated depressions of the trigger shorten the lateral member by each depression of the trigger. Once the side members are in contact with corresponding sides of a chair, a further depression of the trigger will tightly clamp the support frame to the chair. The clamp releases the first part and allows the length of the lateral member to be increased when a release button 106*b* is operated.

The first and second strut parts 105*a* and 105*b* may comprise an aperture for engagement with a pin 113 to prevent the first part from sliding out of the second part. The pin is depressed to disengage the pin from the apertures to allow the first part to slide into the second part when the clamp is released.

Preferably the first side plate 102 is rigidly fixed to the strut first part 105*a*, and the second side plate 103 is rigidly fixed to the strut second part 105*b*. For example, the first side plate 102 is welded to the strut first part 105*a*, and the second side plate 103 is welded to the strut second part 105*b*. In one embodiment, the side members are fixed approximately perpendicularly to the lateral member.

An interface pad 112 is provided to an inside surface of each side member 102, 103 for interfacing to or contacting the chair to which the frame 101 is attached. The interface pad is preferably formed from a plastic material and may comprise a roughed or textured surface for providing a friction contact with the sides of the chair. The strut and side members are preferably formed from metal, for example steel or aluminium. The interface pads prevent or reduce contact between the metal components of the frame 101 and the chair so that the chair is protected from damage. The interface pads are affixed to the side member by fasteners or other means such as an adhesive.

The support frame 101 is fitted to a chair by clamping the support frame to the seat back. When fitted, the lateral member 105 extends laterally across the seat back behind the chair. The first and second side members contact sides of the seat back, and the seat back is clamped between the side members by adjusting the length of the lateral member to secure the support frame to the seat back. A clamping force between the sides of the seat back and the side members of the support frame is achieved by setting the length of the strut appropriately. A user or care-giver shortens the length of the lateral member to clamp the chair between the side members. The trigger clamp is particularly useful in setting the lateral distance between the side members as the clamp can be operated single handed.

To assist with positioning the frame onto the chair the side members have a laterally extending flange 109. This flange can be hooked onto a front edge of a back rest frame of the arm chair to which the support frame 101 is being fitted.

A lateral support 130 is attached at one or both sides of the support frame 101. In one form, the support frame further comprises attachment arms 115, 116. A lateral support 130 for contacting a person seated in a chair is attached to the support frame via a said attachment arm 115, 116.

The position of the attachment arm may be adjusted relative to the frame side member so that once the support frame is attached to a chair the position of the lateral supports 130 can be adjusted to suit a particular person using the chair.

The support frame 101 and arms 115, 116 are arranged so that the arms are moveable forward and backward relative to the support frame and chair (movement in the Z direction defined above, the Z direction is indicated in FIG. 4). To achieve forward and backward movement between the arms and the support frame the arms are slidably mounted to the frame. In the illustrated embodiment, the arms have a slot or slots 117, 118 for receiving a fastener or fasteners 120, 121 for fixing the arms 115, 116 to the side members 102, 103 of the support frame 101. Each arm is fitted to a respective side member with a fastener, for example a bolt or machine screw, passing through the slot in the arm. A head of the bolt 120 is located on an inside of the side member 102, 103, and a nut is provided on an outside of the attachment arm. As illustrated, preferably the nut is an easy grip nut comprising a knob or handle that is sized and shaped for operation by hand without the use of a tool such as a spanner.

Preferably each arm 115, 116 is fixed to a respective side member 102, 103 using two fasteners. In the second embodiment illustrated, each attachment arm has two slots and a fastener 120, 121 passing through each slot. Alternatively the attachment arms could have a single slot with two fasteners passing through the single slot for fixing the arms to their respective side members of the support frame. The nut and bolt arrangement clamps the attachment arms 115, 116 to the respective side members 102, 103 of the support frame 1.

In addition to forward and backward movement between the attachment arms and the side members of the support frame, preferably the arms and the support frame are arranged to allow the arms 115, 116 to pivot in the YZ plane relative to the support frame. For example, the attachment arm may be configured to be rotatable or pivotable about a pivot axis extending substantially parallel to the lateral member, or to rotate or pivot about a longitudinal axis of the lateral member, or to pivot in a plane that is parallel to a plane of the side member to which it is attached. Pivoting movement between a said arm and the corresponding side member is provided by an arc shaped slot (not illustrated in FIG. 10) spaced from a fastening hole 123 in the side member, as described with reference to the first embodiment of FIG. 1 and illustrated as slot 22 in FIG. 6. The arms pivot about an axis substantially perpendicular to the plane of the side members 102, 103. One fastener 121 passes through the arc shaped slot in the side member and a slot 117 in the attachment arm. Alternatively an arc shaped slot may be provided in an attachment arm.

With the support frame 101 securely attached to the seat back the position of the arms 115, 116 are adjusted to a desired position with fasteners 120, 121 loosened. Adjustment is made through the slots 117, 118 on the arms 115, 116 and the arc shaped slot 22 on the side members of the frame 101. To fit the arms in the desired position relative to the support frame the fasteners 120, 121 are tightened to clamp the arms to the side members rigidly. Friction between the arms and the side members is sufficient to hold the arms rigidly to the side members under sufficient clamping force. To assist with setting the clamping force one or both fasteners 120, 121 may be fitted with a resilient member, for example a spring, between the nut 124 and the arm 115, 116 or between the nut 124 and a washer 126. Alternatively or additionally some indexing arrangement may be used between the arms and the side members to secure the relative position of these parts.

With the support frame securely attached to the chair and the positions of the arms 115, 116 set appropriately, lateral supports can be fitted to the arms to provide lateral support to a person using the chair. The lateral support 130 is generally an assembly comprising a resilient pad 131, for example a foam pad supported by a rigid backing member. A connecting element or assembly 132 connects between the resilient pad and the support frame 101.

Figure 10:
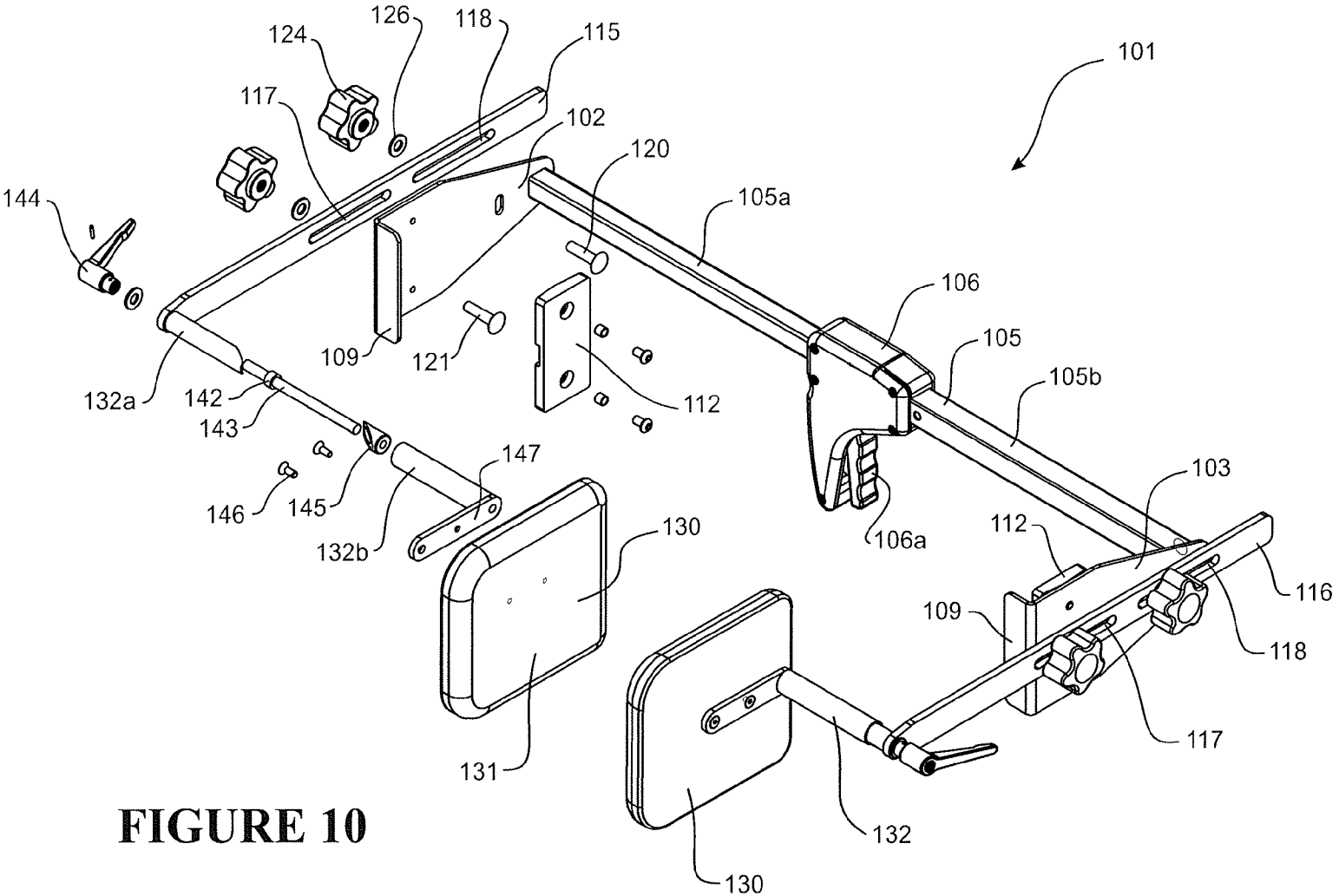
FIG. 10 is a partially exploded perspective view of a support frame together with lateral supports for removably attaching the lateral supports to a chair in accordance with a second embodiment of the invention.
Figure 11:
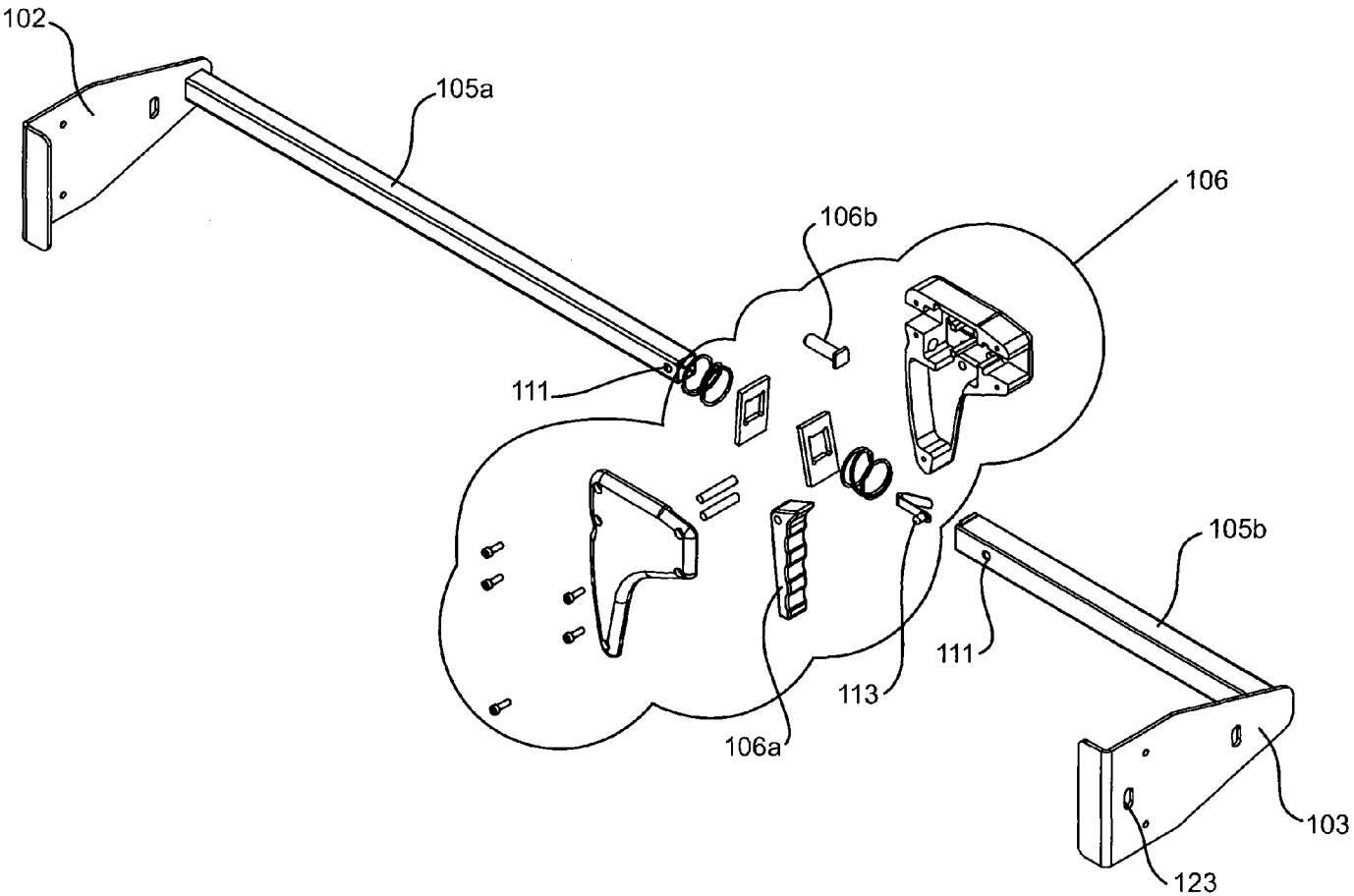
FIG. 11 is an exploded perspective view of some components of the support frame illustrated in FIG. 10.

In the illustrated second embodiment of FIG. 10, the connecting elements comprise a length adjustable assembly 132 for adjusting the lateral position of each lateral support 130. This enables the distance between the opposing lateral supports 130 to be altered so that they can be positioned closer together or further apart. The connecting element 132 is similar in operation to the lateral member 105 and comprises a first part 132*a* attached to or integrally formed with the attachment arm 115, 116 and a second part 132*b* attached to or integrally formed with the lateral support 130. The first part is received inside the second part. Alternatively the second part is attached to or integrally formed with the attachment arm, and the first part is attached to or integrally formed with the lateral support. The length of the connecting element is adjusted by telescoping the first part and second part to lengthen or shorten the connecting element. In the second embodiment the connecting element first and second parts comprise a hollow circular cross section.

To set the relative positions of the connecting element first and second parts, a locking mechanism or clamp is provided between the connecting element first and second parts. The preferred form of the clamp is a wedge clamp comprising a threaded member 143 and a wedge 145. The wedge has a sloping side that contacts a complementary sloping end of the first part 132*a*. When assembled, the threaded member 143 is received inside the first and second parts 132*a*, 132*b*. A knob or handle 144 is provided to an end of the threaded member. For example, the handle 144 is fixed to the threaded member with a screw or pin. The lateral position of the threaded member is fixed relative to the attachment arm by the handle 144 bearing on an outside of the attachment arm (for example via a washer) and a sleeve or nut 142 positioned on the threaded member and bearing against an inside of the attachment arm. For example, the nut or sleeve 142 is welded to the threaded member. The wedge has a threaded bore for receiving the threaded member so that rotation of the threaded member by the handle 144 causes movement of the wedge along the threaded member. Once the lateral support 130 has been correctly positioned, the first and second parts are clamped together. To clamp the first and second parts together, the handle is turned to wind the wedge along the threaded member so the complementary sloping surfaces of the first part and the wedge contact. The outside diameter of the wedge is slightly smaller than the inside diameter of the second part. Further movement of the wedge causes the wedge (and thread) to move slightly sideways with respect to the inside of the second part so that the outside diameter of the wedge and the first part contacts and grips the inside of the second part to clamp the first and second parts together. The connecting element clamp preferably allows relative rotation of the connecting element first and second parts, so that the lateral support can rotate relative to the side member about a longitudinal axis of the connecting element.

The connecting element second part is attached to the lateral support via, for example, screws 146 passing through a flange 147 fixed to an end of the second member. As illustrated, the connecting element 132 may be attached to the lateral support 130 so that a longitudinal axis of the connecting element is located towards a side of the lateral support so that rotation of the second member relative to the first member causes some height adjustment of the lateral support.

In another embodiment of the lateral support apparatus, a hinge is provided between the side member 2, 3, 102, 103 and the lateral support 30, 130 to allow the lateral support to be pivoted away from the front of a chair to which the support frame 1, 101 is attached. A person requiring lateral support may be seated in a chair with the lateral support pivoted away from the front of the chair to a side of the chair. Once the person is seated, a care giver or nurse may pivot the lateral support to the front of the chair for supporting the person.

The hinge (not illustrated) may be provided at the attachment arm 15, 16, 115, 116, or at the side member 2, 3, 102, 103 forward of a clamping position between the side member and chair. Alternatively the hinge could be located at the connecting element. For example, a hinge may be provided between an end of the attachment arm and an end of the connecting element 32, 132.

The hinge must be operable to be fixed in an in-use position with the lateral arm positioned for use, so that the lateral support will not pivot or move when a person rests against the lateral support. A suitable hinge that comprises a mechanism for locking the position of the hinge is the E-Z Access swing away hinge pivot from Adaptive Equipment Systems (www-.sunrisemedical.com).

The present invention has been described by way of example with reference to a removable lateral support system or apparatus comprising the support frame 1, 101, lateral supports 30, 130 and lateral support connecting elements 32, 132. The attachment arms 15, 16, 115, 116 have been described as being part of the support frame. However, the arms may equally be described as being part of a lateral support assembly for attachment to the support frame, the frame comprising the lateral members 4, 5, 105 and the two side members 2, 3, 102, 103. Alternatively the lateral support connecting element 32, 132 and a said attachment arm 15, 115 or 16, 116 may be integrally formed as a single part. Alternatively the lateral support connecting element 32, 132 may be arranged to attach directly to the frame side member 2, 102, 3, 103 or the attachment arm 15, 16, 115, 116 may be arranged for attachment directly to the lateral support 30, 130.

The foregoing description of the invention includes preferred forms thereof. Modifications may be made thereto without departing from the scope of the invention as defined by the accompanying claims.

The invention claimed is:

1. An apparatus for removably attaching a lateral support to a chair comprising:

a support frame removably attachable to a seat back of the chair, the support frame comprising two side members and a lateral member coupled between the side members spacing the side members apart by a lateral distance, and an adjustment mechanism that is operable to adjust the lateral distance between the two side members to clamp the seat back of the chair between the side members with the lateral member extending laterally across the seat back behind the chair, a lateral support, an attachment arm attached to a said side member, the attachment arm and the corresponding side member adapted for positional adjustment therebetween, and a connecting element for supporting the lateral support from the attachment arm, the connecting element comprising a length adjustable assembly for adjusting the length of the connecting element for positioning the lateral support laterally.

2. An apparatus as claimed in claim 1 wherein the attachment arm is moveable relative to the corresponding side member in a forward and backward direction relative to the chair.

3. An apparatus as claimed in claim 1 wherein the lateral support is a resilient pad with a rigid back for attachment to the support frame.

4. An apparatus as claimed in claim 1 wherein a said side member comprises a laterally extending flange adapted to hook onto a front edge of a back rest frame of the chair.

5. An apparatus as claimed in claim 1 wherein the length of the lateral member is adjustable using the adjustment mechanism to clamp the chair between the side members.

6. An apparatus as claimed in claim 5 wherein the lateral member is an adjustable length strut comprising a first strut part and a second strut part, the first part received in the second part, and the adjustment mechanism sets the position of the strut first part relative to the strut second part to set the length of the strut.

7. An apparatus as claimed in claim 1 wherein the attachment arm is pivotable relative to the corresponding side member in a plane that is parallel to a plane of the corresponding side member.

8. An apparatus as claimed in claim 7 wherein the attachment arm is attached to the side member with fasteners, one fastener passed through an arc shaped slot in one of the attachment arm and the side member, the arc shaped slot allowing the attachment arm to rotate relative to the side member.

9. An apparatus as claimed in claim 1 wherein the attachment arm is attached to the side member with a fastener passed through at least one slot in one of the attachment arm and the side support, the at least one slot allowing relative movement between the attachment arm and the side member, the relative position of the attachment arm and the side member being set by tightening the fastener to rigidly clamp the attachment arm to the side member.

10. An apparatus as claimed in claim 9 wherein the slot is aligned in a forward and backward direction allowing forward and backward positioning of the attachment arm relative to the support frame.

* * * * *